US011946209B2

(12) United States Patent
Heindtel et al.

(10) Patent No.: US 11,946,209 B2
(45) Date of Patent: Apr. 2, 2024

(54) SWITCHING ASSEMBLY FOR AN ELECTRIC SCREED HEATING DEVICE OF A ROAD PAVER

(71) Applicant: JOSEPH VOEGELE AG, Ludwigshafen/Rhein (DE)

(72) Inventors: Michael Heindtel, Mannheim (DE); Achim Eul, Mannheim (DE)

(73) Assignee: Joseph Voegele AG, Ludwigshafen/Rhein (DE)

( * ) Notice: Subject to any disclaimer, the term of this patent is extended or adjusted under 35 U.S.C. 154(b) by 440 days.

(21) Appl. No.: 17/388,496

(22) Filed: Jul. 29, 2021

(65) Prior Publication Data

US 2022/0034048 A1 Feb. 3, 2022

(30) Foreign Application Priority Data

Jul. 29, 2020 (EP) ..... 20188392

(51) Int. Cl.
*E01C 19/48* (2006.01)

(52) U.S. Cl.
CPC ..... *E01C 19/4873* (2013.01); *E01C 2301/10* (2013.01)

(58) Field of Classification Search
CPC ..... E01C 19/4873; E01C 2301/10
USPC ..... 404/72, 77, 79, 95, 118
See application file for complete search history.

(56) References Cited

U.S. PATENT DOCUMENTS

| | | | | |
|---|---|---|---|---|
| 6,421,594 | B1 | 7/2002 | Erasmus | |
| 7,993,075 | B2 | 8/2011 | Nelson | |
| 8,784,003 | B2 * | 7/2014 | Heindtel | E01C 19/48 404/108 |
| 9,209,103 | B2 | 12/2015 | Xu et al. | |
| 9,601,984 | B2 | 3/2017 | Hamanaka et al. | |
| 10,538,886 | B2 | 1/2020 | Buschmann et al. | |
| 10,760,228 | B2 | 9/2020 | Heindtel et al. | |
| 10,974,726 | B2 | 4/2021 | Lachmann et al. | |
| 2015/0037097 | A1 | 2/2015 | Caputo | |
| 2022/0034048 | A1 | 2/2022 | Heindtel et al. | |
| 2023/0185320 | A1 * | 6/2023 | Lindemann | E01C 19/42 404/77 |

FOREIGN PATENT DOCUMENTS

| | | |
|---|---|---|
| CN | 102074761 A | 5/2011 |
| CN | 102884721 A | 1/2013 |
| CN | 108691259 A | 10/2018 |

(Continued)

OTHER PUBLICATIONS

Chinese Search Report (with English Machine Translation) dated Apr. 10, 2023, Application No. 202110855874.5, 4 Pages.

(Continued)

*Primary Examiner* — Raymond W Addie
(74) *Attorney, Agent, or Firm* — Brooks Kushman P.C.

(57) ABSTRACT

A road paver comprises a tractor vehicle with a material hopper for receiving paving material and a paving screed for compacting paving material. The paving screed comprises at least one electric heating device for heating the paving screed. The road paver comprises at least one electric switching assembly configured to switch an electric power supply of the electric heating device. The electric switching assembly comprises an electric parallel circuit of two switching devices, wherein the electric parallel circuit of the two switching devices forms a series electric circuit with the electric heating device.

14 Claims, 3 Drawing Sheets

(56) References Cited

FOREIGN PATENT DOCUMENTS

| | | | |
|---|---|---|---|
| CN | 216515000 | U | 5/2022 |
| DE | 19912248 | A1 | 9/2000 |
| DE | 10 2015 012298 | A1 | 3/2017 |
| EP | 1 295 990 | A2 | 3/2003 |
| EP | 1 036 883 | B1 | 7/2004 |
| EP | 3 527 721 | A1 | 8/2019 |
| JP | 2015 094312 | A | 5/2015 |

OTHER PUBLICATIONS

Chinese Second Office Action (with English Machine Translation) dated Apr. 15, 2023, Application No. 202110855874.5, 11 Pages.
Chinese Search Report (with English Machine Translation) dated Jun. 7, 2023, Application No. 202110855874.5, 4 Pages.
Chinese Rejection Decision (with English Machine Translation) dated Jun. 13, 2023, Application No. 202110855874.5, 10 Pages.
Zhang Ming et al., Electric Technology Innovation Experiment, Northwestern University Press, Copyright 2009, Published May 31, 2009, 11 Pages.
State Grid Ningxia Electric Power Co., Ltd., Examination Database for Electric Dispatchers' Operating Skills, State Grid Ningxia Electric Power Co., Ltd., 2016, 10 Pages.
European Search Report dated Jan. 13, 2021, Application No. 20188392.3-1002, Applicant Joseph Voegele AG, 6 Pages.
Chinese Search Report (with English Machine Translation) dated Oct. 24, 2022, Application No. 202110855874.5, 4 Pages.
Chinese Office Action (with English Machine Translation) dated Nov. 1, 2022, Application No. 202110855874.5, 9 Pages.

* cited by examiner

SWITCHING ASSEMBLY FOR AN ELECTRIC SCREED HEATING DEVICE OF A ROAD PAVER

CROSS-REFERENCE TO RELATED APPLICATIONS

This application claims foreign priority benefits under 35 U.S.C. § 119(a)-(d) to European patent application number EP 20188392.3, filed Jul. 29, 2020, which is incorporated by reference in its entirety.

TECHNICAL FIELD

The disclosure relates to the electric heating of a paving screed of a road paver.

BACKGROUND

Known road pavers comprise a material hopper at the front of the tractor vehicle of the road paver for receiving material to be paved with respect to a paving direction. During paving, the material to be paved is conveyed from the material hopper via a longitudinal conveyor to a rear area of the road paver. There, the paving material is distributed transversely to the paving direction by means of a spreading auger and is thus evenly fed to a paving screed towed by the tractor vehicle for compacting the paving material. It is known to heat working components of the paving screed, such as tamper bars, screed plates and/or pressure bars, electrically or with gas to prevent sticking of the hot paving material. In the case of electric heating, resistance heating elements supplied with electric power via a generator provided on the tractor vehicle are distributed in the paving screed.

In EP 1 036 883 B1, it was recognized that permanently operating the electric heating elements of the paving screed at full power may significantly stress the generator under unfavorable operating conditions and also may have low energy efficiency. In order to solve these problems, a clocked switching of the electric heating elements of the paving screed is proposed. Supply lines lead from a generator provided on the tractor vehicle to the electric heating elements integrated on the two screed halves (left and right screed half) of the paving screed. Contactors are provided in the supply lines so that one contactor is assigned to each screed half. By means of temperature-dependent resistors in the windings of the generator, the temperature of the generator is monitored. If the temperature of the generator exceeds a certain threshold value, operation of the heating elements of the paving screed is switched to a clocked operation. This means, for example, that the heating elements in the left screed half are switched off for a predetermined period of time, e.g., 30 seconds, and only the heating elements in the right screed half remain switched on. After the predetermined time period has elapsed, the heating elements in the right screed half are switched off and the heating elements in the left screed half are switched on again. This is repeated permanently, allowing the generator to cool down again.

From EP 1 295 990 B2, a road paver is known which comprises a paving screed with a base screed segment and extension segments provided on both sides of the base screed segment to increase the paving width. The paving screed is divided into four sections. In each of the sections, four resistance heating elements are provided for heating the respective screed section. The heating elements are connected to a generator of the road paver via relay switches for power supply, wherein a common relay switch is connected upstream of two adjacent heating elements in each case. By means of a control device, the relay switches corresponding to the heating elements of a section are closed to supply the heating elements if a temperature measured at the section is below a first threshold value. If the measured temperature exceeds a higher, second threshold value, the associated relay switches are opened again to interrupt heating of the section. This is intended to keep the screed sections within a suitable temperature window.

From EP 3 527 721 A1, a road paver is known on the paving screed of which a plurality of electric heating devices are provided. The electric heating devices are supplied with electric power provided by a generator by means of a power distribution arrangement. The power distribution arrangement comprises a plurality of power adjustment devices provided on the paving screed. In each case, a power adjustment device is assigned to a corresponding electric heating device. The power adjustment devices are controlled to dynamically adjust the power supplied to the respective electric heating device. The power adjustment devices may, for example, comprise thyristor controllers. Due to heat generation in the power controllers during operation, it must be ensured that the power controllers are designed for the rated power of the heating devices, which may lead to high costs, especially for larger rated powers.

SUMMARY

It is an object of the disclosure to provide, by simple means, an economical and low-maintenance power supply for an electric screed heating system.

This object is achieved by a road paver according to the disclosure, by a method according to the disclosure for heating a paving screed of a road paver, and by a use according to the disclosure.

A road paver according to the disclosure comprises a tractor vehicle with a material hopper for receiving paving material and a paving screed for compacting paving material. The paving screed comprises at least one electric heating device for heating the paving screed. The paver comprises at least one electric switching assembly configured to switch an electric power supply of the electric heating device. The electric switching assembly comprises an electric parallel circuit of two switching devices. The electric parallel circuit of the two switching devices forms an electric series circuit with the electric heating device.

Since the two switching devices are connected in parallel, the electric heating device may be supplied with electric power even if one of the switching devices does not allow current to flow. It is therefore not necessary for current to flow permanently through both switching devices during operation of the heating device. If the switching devices do not need to be permanently energized during operation of the electric heating device, switching devices with a lower rated current (based on continuous operation) may be used. If the switching devices do not have to be permanently energized during operation of the electric heating device, heating of the switching devices during operation may be reduced. By using two "smaller" dimensioned switching devices, a "cost saving may be achieved compared to the use of one "larger" switching device. Since the electric parallel circuit of the two switching devices forms an electric series circuit with the electric heating device, the electric heating device may be operated in the same way irrespective of through which one of the two switching devices current flows.

The two switching devices may be configured to alternately supply the electric heating device with electric power. For example, the two switching devices may be controlled by a control unit of the road paver to alternately supply the electric heating device with electric power. When the two switching devices alternately supply the electric heating device, the two switching devices may be alternately conducting current and not conducting current. If one of the switching devices heats up in a conducting phase, it may cool down at least to some degree in the subsequent non-conducting phase without terminating, interrupting, and/or impairing the operation of the electric heating device. This may counteract damage to the switching devices due to overheating.

The two switching devices may be connected to a common input of the electric heating device. The electric switching assembly with the two switching devices connected in parallel to one another may be used with a conventional electric heating device with only one input. Operation of the electric heating device may be independent of which one of the two switching devices is supplies current.

The electric switching assembly may be provided on the paving screed. Providing the electric switching assembly on the paving screed is particularly preferred if several electric heating devices for heating the paving screed are provided on the paving screed, each of which is assigned an electric switching assembly. The provision of the electric switching assemblies on the paving screed simplifies the electric connection of the paving screed to the tractor vehicle.

The two switching devices may be semiconductor switching devices. Since semiconductor switching devices are comparatively temperature-sensitive, the avoidance of heating achieved by connecting two switching devices in parallel to supply an electric heating device is particularly relevant. The semiconductor switching devices may be configured to variably adjust an electric power supplied to the electric heating device.

The two switching devices may each comprise a transistor or be formed as a transistor. In particular, the two switching devices may each comprise a bipolar transistor or be formed as a bipolar transistor. In particular, the two switching devices may each comprise an insulated gate bipolar transistor (IGBT) or be formed as an insulated gate bipolar transistor (IGBT). In particular, the two switching devices may each comprise a field effect transistor or be formed as a field effect transistor. The two switching devices may each comprise a thyristor or be formed as a thyristor. In particular, the two switching devices may each comprise a gate turn-off thyristor (GTO) or be formed as a gate turn-off thyristor (GTO). The two switching devices may each comprise a bidirectional thyristor diode (TRIAC) or be formed as a bidirectional thyristor diode (TRIAC).

The electric switching assembly may be configured to provide an AC voltage to the electric heating device. The AC electric voltage may be provided by a generator of the road paver.

Each one of the two switching devices may be configured to let at least one complete sine wave of the AC voltage pass in one go. Each one of the two switching devices may be configured to operate the electric heating device alone (without the other switching device), at least for a limited time. Each one of the two switching devices may be configured to let less than 100, less than 80, less than 50, less than 40, less than 20, less than ten, less than five, or less than two complete sine waves of the AC voltage pass in one go. Each one of the two switching devices may be configured to let at least one, at least two, at least five, at least ten, or at least 20 complete sine waves of the AC voltage pass in one go. By limiting the duration of current flow through a single switching device, heating of the switching device may be effectively limited.

The two switching devices may be configured to let successive sine waves of the AC voltage pass in an alternating manner.

The electric heating device may be a resistive element. The electric heating device may be a heating rod.

The disclosure also relates to a method for heating a paving screed of a road paver. The method comprises supplying electric power to at least one electric resistance heating element provided on the paving screed. An electric power supply to the electric resistance heating element is switched by an electric switching assembly. The electric switching assembly comprises two switching devices. The two switching devices of the electric switching assembly alternately supply the electric resistance heating element with electric power.

When the two switching devices of the electric switching assembly alternately supply electric power to the electric resistance heating element, one of the two switching devices may be without current flow while current flows through the other switching device. The switching device without current flow has the opportunity to cool down while the electric resistance heating element is supplied by the other switching device.

The electric resistance heating element may be supplied with an AC voltage.

A frequency of switching the supply of the electric resistance heating element between the two switching devices may correspond to a frequency of the AC electric voltage. A frequency of switching the supply of the electric resistance heating element between the two switching devices may be smaller than a frequency of the AC electric voltage.

The electric resistance heating element may be continuously supplied with electric power during the alternating power supply by the two electric switching devices.

The disclosure also relates to a use of two alternately switched switching devices in an electric switching assembly for supplying electric power to an electric heating device on a paving screed of a road paver to reduce a risk of overheating of the electric switching assembly.

Since the two switching devices are alternately switched, one of the two switching devices may cool down while the other switching device supplies power to the electric heating device.

As described, according to an aspect, the disclosure provides a road paver, according to another aspect, a method for heating a paving screed of a road paver, and according to yet another aspect, a use of two alternately switched switching devices. Features, advantages, and explanations described with respect to one of these aspects are transferable to the other aspects.

BRIEF DESCRIPTION OF THE DRAWINGS

In the following, an embodiment according to the disclosure is further explained.

DETAILED DESCRIPTION

Figure 1:
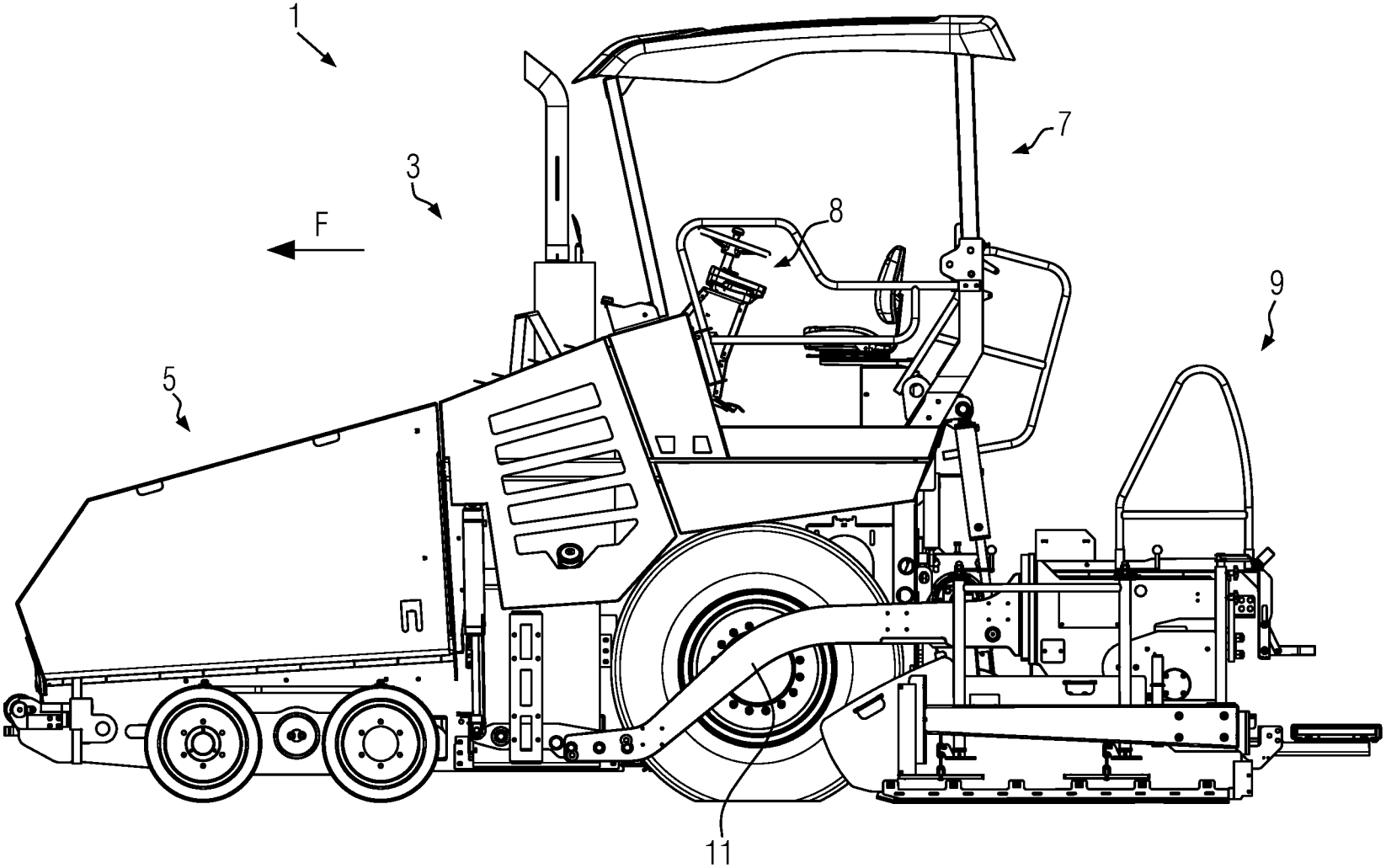
FIG. 1 shows a schematic side view of a road paver according to an embodiment.

FIG. 1 shows a schematic side view of a road paver 1 according to an embodiment. The road paver 1 comprises a self-propelled tractor vehicle 3 with a material hopper 5 for receiving paving material located at the front in paving direction F. Further, an operator station 7 is provided on the tractor vehicle 3, the operator station 7 comprising input devices 8 for controlling the road paver 1 and providing space for an operator. A paving screed 9 for compacting the paving material is pulled behind the tractor vehicle 3 via drawbars 11 attached to both sides of the tractor vehicle 3. A conveyor is provided on the tractor vehicle 3 for conveying paving material from the material hopper 5 to a rear area of the road paver 1. In the rear area of the road paver 1, the paving material leaves the conveyor through a material outlet and reaches a spreading auger 13 (see FIG. 2) for distributing the paving material in front of the paving screed 9 transverse to the paving direction F.

Figure 2:
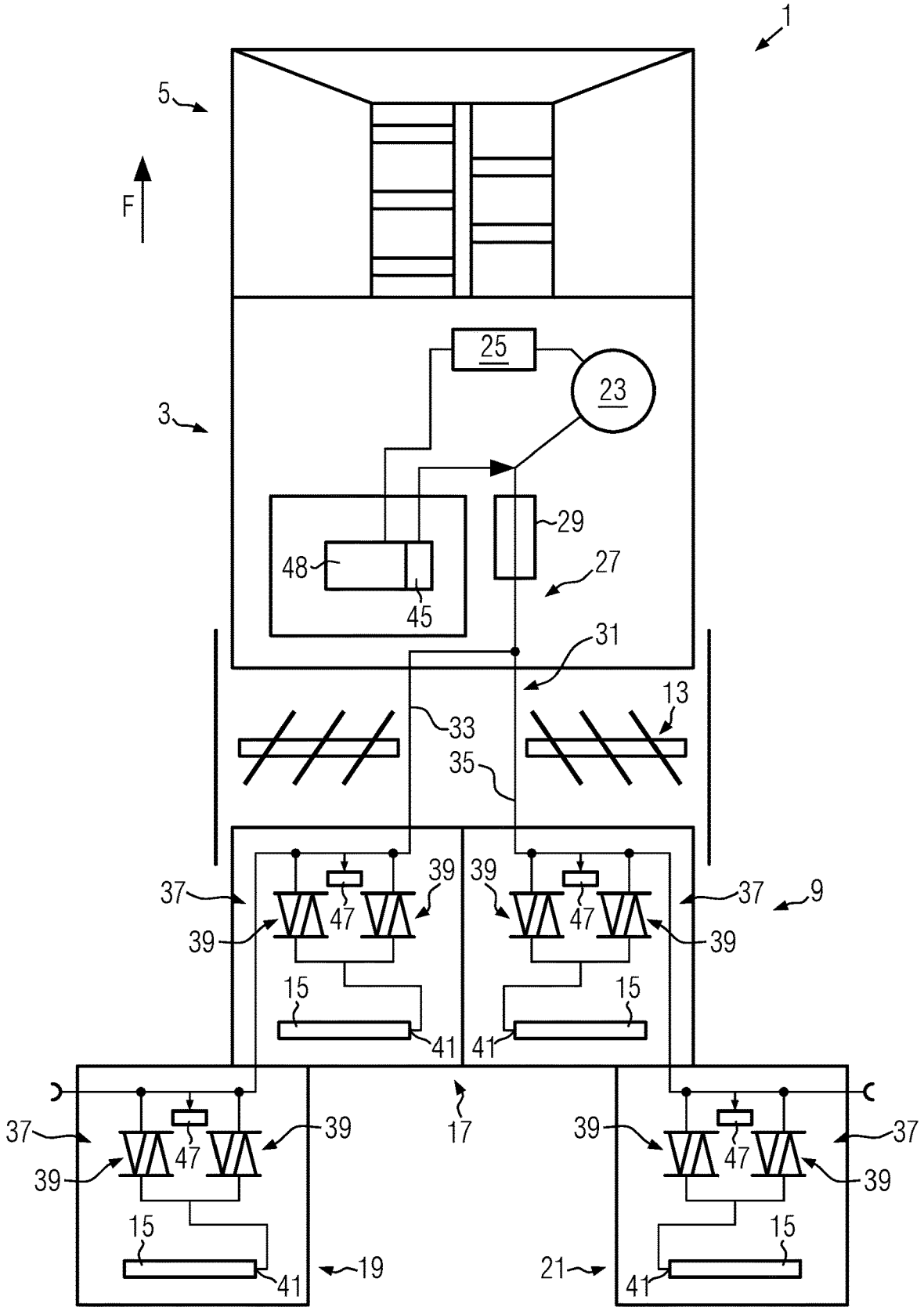
FIG. 2 shows a schematic top view of a road paver according to an embodiment.

As shown in FIG. 2, a plurality of electric heating devices 15 are provided on the paving screed 9 for electrically heating the paving screed 9. The heating devices 15 may be resistance heating elements, in particular heating rods. The heating devices 15 may be adapted to heat the paving screed 9 substantially to the temperature of the hot paving material to prevent the paving material from sticking to the paving screed 9. In the illustrated embodiment, the paving screed 9 is an extendable screed with a base screed 17 and extending units 19, 21 attached to the base screed 17 laterally on both sides with respect to the paving direction F. The extending units 19, 21 may be moved in and out to adjust the paving width. However, it may also be conceivable that the paving screed 9 comprises only the base screed 17, without any extending units 19, 21 being provided. Electric heating devices 15 may be provided both on the base screed 17 and on the extending units 19, 21.

A generator 23 is provided on the tractor vehicle 3. The generator 23 is driven by an engine 25, in particular a diesel engine, of the tractor vehicle 3 and provides electric power. The electric power from the generator 23 is used, among other things, to supply the electric heating devices 15. A power supply arrangement 27 connects the generator 23 to the electric heating devices 15 on the paving screed 9 to provide electric power to the electric heating devices 15. The power supply arrangement 27 comprises a main fuse 29 on the tractor vehicle 3. A line network 31 of the power supply arrangement 27 leads from the generator 23 via the main fuse 29 to the paving screed 9. In the illustrated embodiment, the line network 31 branches on the tractor vehicle 3 into two strands 33, 35, which are led to the paving screed 9 and supply a left screed half and a right screed half, respectively. On the paving screed 9, the line network 31 branches out further to supply the individual electric heating devices 15.

An electric switching device 37 is assigned to each of the electric heating devices 15. The electric switching assemblies 37 are each electrically connected in series with the corresponding electric heating device 15. In the illustrated embodiment, there are four electric switching assemblies 37 corresponding to the illustrated four electric heating devices 15. The electric switching assemblies 37 are each connected upstream of the corresponding electric heating device 15. The series circuits consisting of the electric switching assemblies 37 and the respective corresponding electric heating devices 15 may be connected in parallel with one another. However, it would also be conceivable that the series circuits comprising the electric switching assemblies 37 and the corresponding electric heating devices 15 are present independently of one another, for example in different circuits.

The electric switching assemblies 37 each comprise two switching devices 39 electrically connected in parallel with one another. The electric parallel circuit of the two switching devices 39 of an electric switching assembly 37 is in each case connected in series with the associated electric heating device 15. The associated electric heating device 15 comprises a common input 41 via which it is connected to both switching devices 39 of the associated electric switching assembly 37. Each switching device 39 may be set to a current-conducting state, in which a current flows through the switching device 39 that supplies electric power to the associated electric heating device 15. Each switching device 39 may be set to a non-current-conducting or blocking state, in which current flow through the electric switching device 39 to the electric heating device 15 is prevented.

For example, the two switching devices may each comprise a transistor or be formed as a transistor. In particular, the two switching devices may each comprise a bipolar transistor or be formed as a bipolar transistor. In particular, the two switching devices may each comprise an insulated gate bipolar transistor (IGBT) or be formed as an insulated gate bipolar transistor (IGBT). In particular, the two switching devices may each comprise a field-effect transistor or be formed as a field-effect transistor. For example, the two switching devices may each comprise a thyristor or be formed as a thyristor. In particular, the two switching devices may each comprise a gate turn-off thyristor (GTO) or be formed as a gate turn-off thyristor (GTO). For example, the two switching devices may each comprise a bidirectional thyristor diode (TRIAC) or be formed as a bidirectional thyristor diode (TRIAC).

Operation of the electric switching assemblies 37 is controlled by a controller 48. In the illustrated embodiment, operation of the electric switching assemblies 37 is controlled by a controller 48 provided on the tractor vehicle 3. However, the controller 48 could also be partially or fully provided on the paving screed 9. In the illustrated embodiment, the controller 48 comprises a communication module 45 that is in data exchange communication with communication modules 47 of the electric switching assemblies 37. In the illustrated embodiment, the data exchange connection between the controller 48 and the electric switching assemblies 37 runs on the line network 31 as power line communication. However, the data exchange connection could also be implemented in other ways, such as by wireless or wired data transmission. The communication modules 47 may be connected to the switching devices 39 in order to control them. The communication modules 47 may be connected to the switching devices 39 directly or via intermediate elements, such as sub-controllers. Alternatively, it might be conceivable that the switching devices 39 are connected directly (without intermediate communication modules 47) to the controller 48 or a sub-controller. For example, the switching devices 39 may be controlled via a gate connection.

Figure 3:
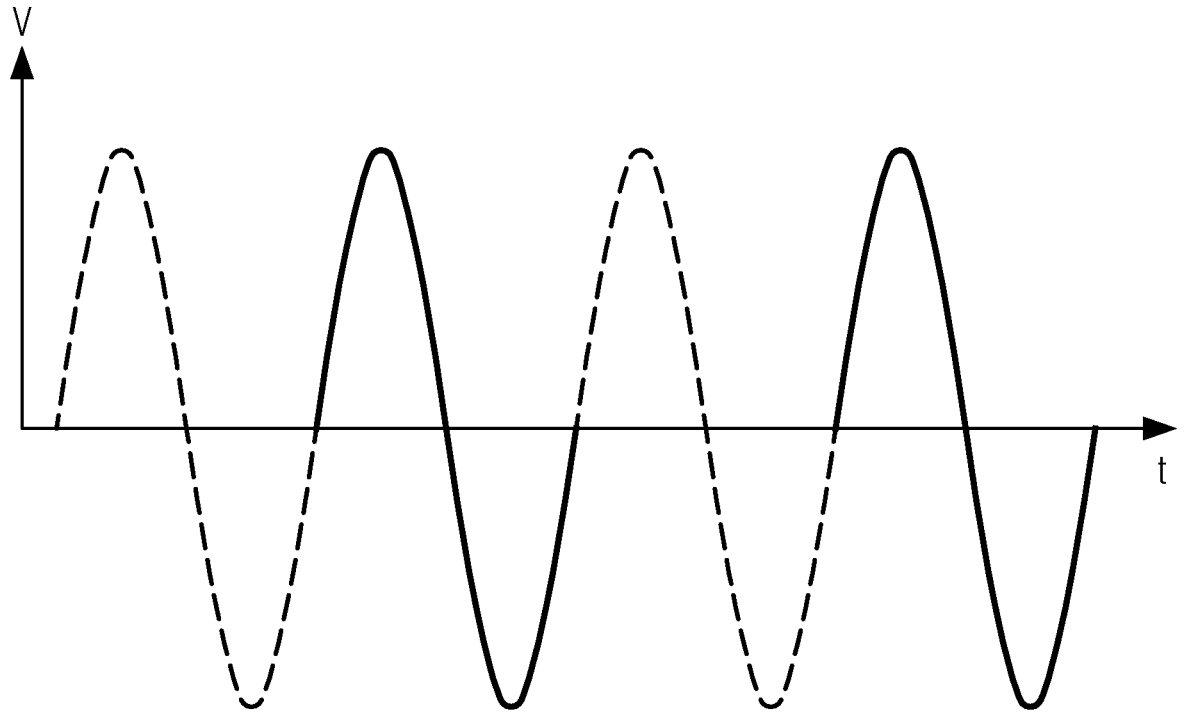
FIG. 3 shows a schematic representation of the alternating supply of the electric heating device by two switching devices connected in parallel to each other, according to an embodiment.

The two switching devices 39 of an electric switching assembly 37 are controlled such that they alternately supply electric power to the corresponding electric heating device 15. Preferably, in operation, always one of the two switching devices 39 is in a blocking state and the other one of the two switching devices is in a current conducting state for supplying electric power to the corresponding electric heating device 15. Different timings for switching between the two switching devices 39 of an electric switching assembly 37 are conceivable. For example, when the electric heating devices 15 are supplied with an AC voltage, switching between the two switching devices 39 of an electric switching assembly 37 may be performed such that a complete sine wave of the AC voltage is passed by one of the switching devices 39 to the electric heating device 15 and the complete subsequent sine wave is then passed by the other switching device 39 to the electric heating device 15, and so on. This case is illustrated in FIG. 3, which shows a time evolution of a voltage at the input 41 of an electric heating device 15. The time intervals in which power is supplied to the electric heating device 15 via a first switching device 39 of the corresponding electric switching assembly 37 are shown in dashed lines in FIG. 3. The second switching device 39 is blocking in the corresponding time intervals. The time intervals in which power is supplied to the electric heating device 15 via the second switching device 39 of the electric switching assembly 37 are shown in solid lines in FIG. 3. In these time intervals, the first switching device 39 is blocking.

It is not mandatory that the timing of the two switching devices 39 of an electric switching assembly 37 corresponds to the situation shown in FIG. 3. In principle, the timing between a supply of the electric heating device 15 by the first switching device 39 and a supply of the electric heating device 15 by the second switching device 39 may be chosen as desired. Preferably, a frequency of the switching of the supply of the electric heating device 15 between the two switching devices 39 is in the range of a frequency of the AC electric voltage. It would, for example, also be conceivable that the switching devices 39 each let pass more than one complete sine wave of the AC voltage and only then switch over to the other switching device 39.

What is claimed is:

1. A road paver, comprising:

a tractor vehicle with a material hopper for receiving paving material;

a paving screed for compacting paving material, wherein the paving screed comprises an electric heating device for heating the paving screed; and an electric switching assembly configured to switch an electric power supply of the electric heating device, wherein the electric switching assembly comprises an electric parallel circuit of two switching devices, and wherein the electric parallel circuit of the two switching devices forms an electric series circuit with the electric heating device.

2. The road paver according to claim 1, wherein the two switching devices are configured to alternately supply electric power to the electric heating device.

3. The road paver according to claim 1, wherein the two switching devices are connected to a common input of the electric heating device.

4. The road paver according to claim 1, wherein the electric switching assembly is provided on the paving screed.

5. The road paver according to claim 1, wherein the two switching devices are semiconductor switching devices.

6. The road paver according to claim 1, wherein the two switching devices each comprise a transistor, a thyristor or a bidirectional thyristor diode.

7. The road paver according to claim 1, wherein the electric heating device is a resistance heating element.

8. The road paver according to claim 1, wherein the electric switching assembly is configured to supply an AC voltage to the electric heating device.

9. The road paver according to claim 8, wherein each switching device is configured to let at least one complete sine wave of the AC voltage pass in one go.

10. The road paver according to claim 8, wherein the two switching devices are configured to let successive sine waves of the AC voltage pass in an alternating manner.

11. A method for heating a paving screed of a road paver, comprising:

supplying electric power to an electric resistance heating element provided on the paving screed;

wherein an electric power supply to the electric resistance heating element is switched with an electric switching assembly, and wherein two switching devices of the electric switching assembly alternately supply the electric resistance heating element with electric power.

12. The method according to claim 11, wherein the electric resistance heating element is supplied with an AC voltage, and wherein a frequency of switching the supply to the electric resistance heating element between the two switching devices corresponds to a frequency of the AC voltage.

13. The method according to claim 11, wherein the electric resistance heating element is continuously supplied with electric power during the alternating power supply by the two electric switching devices.

14. A method for heating a paving screed of a road paver, the method comprising using two alternately switched switching devices in an electric switching assembly for supplying electric power to an electric heating device on the paving screed of the road paver to reduce a risk of overheating of the electric switching assembly.

* * * * *